US006966289B1

(12) United States Patent
Butterfield

(10) Patent No.: US 6,966,289 B1
(45) Date of Patent: Nov. 22, 2005

(54) VCT MECHANISM INCORPORATING CAMSHAFT BEARING JOURNAL

(75) Inventor: Roger P. Butterfield, Trumansburg, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/040,738

(22) Filed: Jan. 21, 2005

(51) Int. Cl.[7] ..... F01L 1/34
(52) U.S. Cl. ..... 123/90.17; 123/90.15; 123/90.31
(58) Field of Search ..... 123/90.15, 90.17, 123/90.31

(56) References Cited

U.S. PATENT DOCUMENTS

| | | | | |
|---|---|---|---|---|
| 4,723,517 A | | 2/1988 | Frost | 123/90.31 |
| 5,718,196 A | | 2/1998 | Uchiyama et al. | 123/195 C |
| 5,816,205 A | * | 10/1998 | Moriya | 123/90.17 |
| 5,829,399 A | | 11/1998 | Scheidt et al. | 123/90.17 |
| 6,035,817 A | | 3/2000 | Uchida | 123/90.17 |
| 6,186,105 B1 | | 2/2001 | Yonezawa | 123/90.17 |
| 6,325,031 B1 | * | 12/2001 | Takano | 123/90.17 |
| 2002/0062803 A1 | * | 5/2002 | Sato et al. | 123/90.17 |

FOREIGN PATENT DOCUMENTS

| | | | |
|---|---|---|---|
| JP | 11280431 | 10/1999 | F01L 1/34 |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A variable cam timing phaser for an internal combustion engine having at least one camshaft comprising a housing and a rotor. The housing has an outer circumference for accepting drive force. The rotor has a connection to the camshaft coaxially located within the housing. The housing and the rotor define at least one vane separating a chamber in the housing. The vane is capable of rotation to shift the relative angular position of the housing and the rotor. A portion of the outer circumference of the housing is supported by a journal bearing fixed to a non-rotating part of the engine, which may be the engine block or the cylinder head.

3 Claims, 3 Drawing Sheets

VCT MECHANISM INCORPORATING CAMSHAFT BEARING JOURNAL

BACKGROUND OF THE INVENTION

1. Field of the Invention

The invention pertains to the field of variable cam timing systems. More particularly, the invention pertains to a variable cam timing system supported by a camshaft bearing journal to provide an engine with shorter axial length.

2. Description of Related Art

The axial length of the engine systems, including the variable cam timing (VCT) phaser has been reduced in the prior art to allow the engine to fit into smaller engine spaces. One example of how the engine length was decreased is U.S. Pat. No. 6,035,817, which discloses an internal combustion engine where the camshaft is supported at one end by a combined bearing and valve body plate that is detachable from the supporting engine body. The variable valve timing (VVT) mechanisms are attached to the valve body plate. By attaching the VVT mechanism to the plate, passages may be added to the plate rather than in the cylinder head casing, the driving sprockets are positioned much closer to the bearing surface formed by the plate, and the overall length is decreased relative to the cylinder head fasteners.

Prior art FIG. 1 shows a conventional variable cam timing system that has not been decreased in length and where the variable cam timing (VCT) mechanism or phaser 12 is located in front of the first camshaft journal bearing 6 of the camshaft 4. A second camshaft journal bearing 8 is shown, and additional bearings may also be present. A solenoid 2 actuates the center mounted spool valve 14 of the VCT phaser 12. Sprocket 10 is mounted to the VCT phaser 12 on the side closest to the first camshaft journal bearing 6.

SUMMARY OF THE INVENTION

A variable cam timing phaser for an internal combustion engine having at least one camshaft comprising a housing and a rotor. The housing has an outer circumference for accepting drive force. The rotor has a connection to the camshaft coaxially located within the housing. The housing and the rotor define at least one vane separating a chamber in the housing. The vane is capable of rotation to shift the relative angular position of the housing and the rotor. A portion of the outer circumference of the housing is supported by a journal bearing fixed to a non-rotating part of the engine, which may be the engine block or the cylinder head.

DETAILED DESCRIPTION OF THE INVENTION

Figure 1:
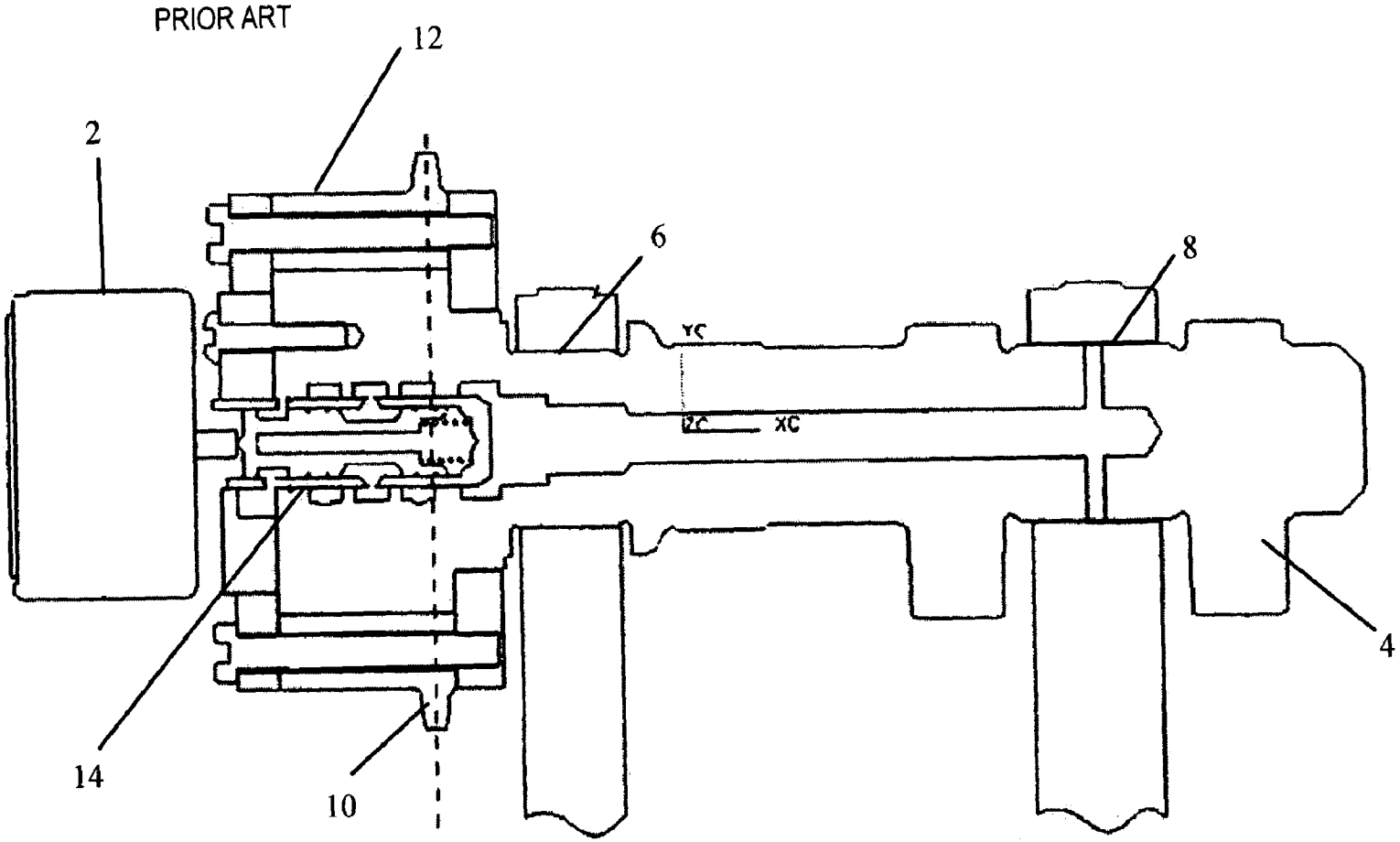
FIG. 1 shows a schematic of the VCT mechanism in relation to the camshaft bearing of the prior art.
Figure 2:
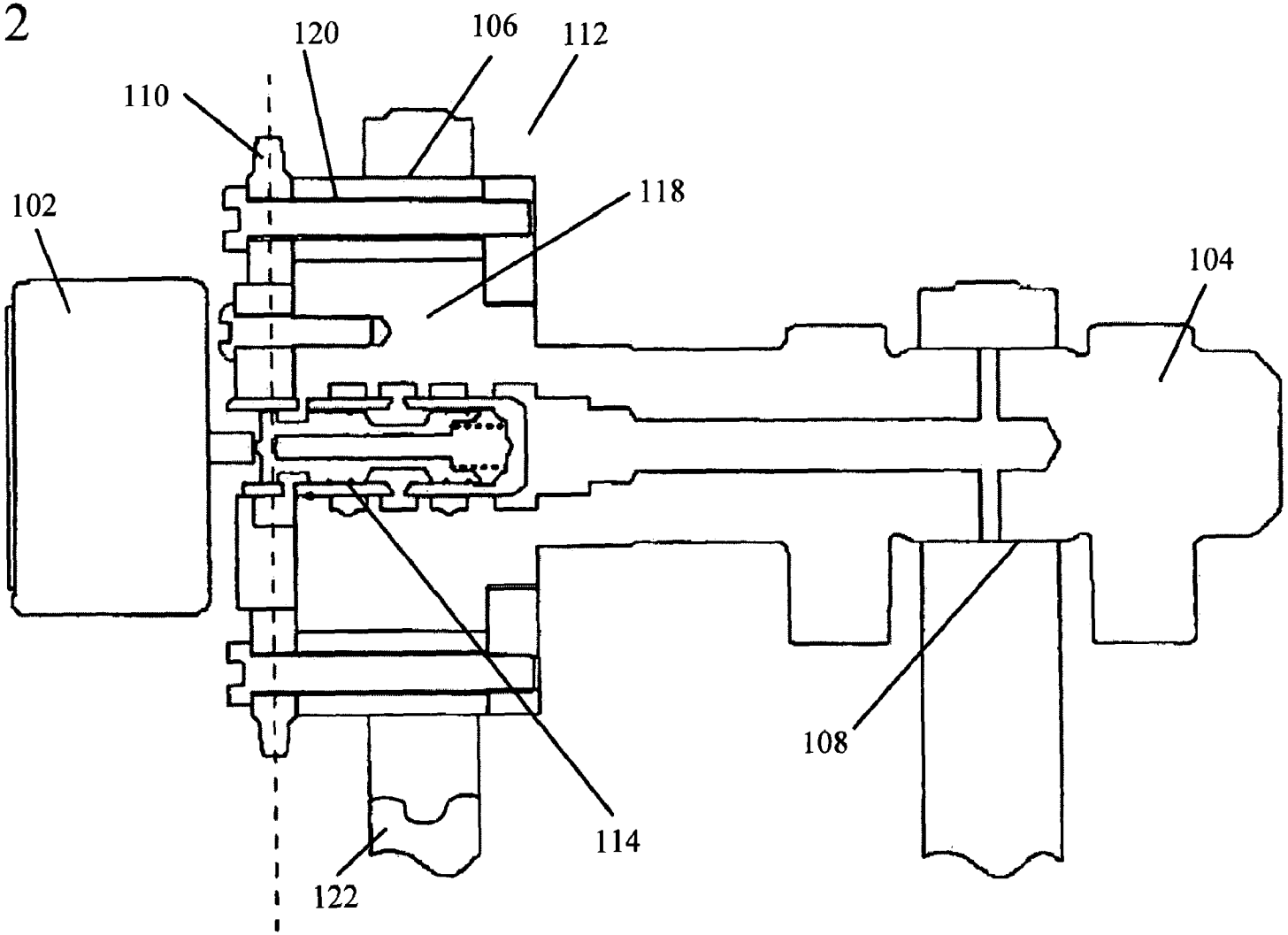
FIG. 2 shows a schematic of the VCT mechanism in relation to the camshaft bearing of the present invention.

FIG. 2 shows a schematic of the variable cam timing (VCT) mechanism or phaser 112 where the axial system length is decreased. The VCT mechanism may use one or more "vane phasers" on the engine camshaft (or camshafts, in a multiple-camshaft engine). In most cases, the phasers have a rotor 118 with one or more vanes, mounted to the end of the camshaft 104, surrounded by a housing 20 with the vane chambers into which the vanes fit. It is possible to have the vanes mounted to the housing 120, and the chambers in the rotor 118, as well. The housing of the VCT mechanism 112 attaches to the sprocket 110 accepting drive force through a chain, usually from the crankshaft (not shown), or possibly from another camshaft in a multiple-cam engine. A control valve 114 is present in the rotor 118. The position of the control valve 114 is altered by the control valve actuator 102. The control valve 114 aids in moving the vane and thus altering the timing of the engine. The control valve 114 may be located remotely from the phaser 112.

A journal bearing 106 supports a portion of the outer circumference of the housing 120. The journal bearing 106 is also fixed to a non-rotating part of the engine, which may be the engine block or the cylinder head 122. The outer circumference of the housing 120 and the journal 106 itself together acts as a camshaft journal bearing having a larger diameter than in the prior art and than the other camshaft journals present on the camshaft 104. By incorporating the camshaft journal bearing 106 onto the VCT mechanism 112, the sprocket 110 for accepting drive force is maintained in the same place as in the prior art, but the overall length of the combination of the VCT mechanism 112 and the camshaft is reduced.

Figure 3:
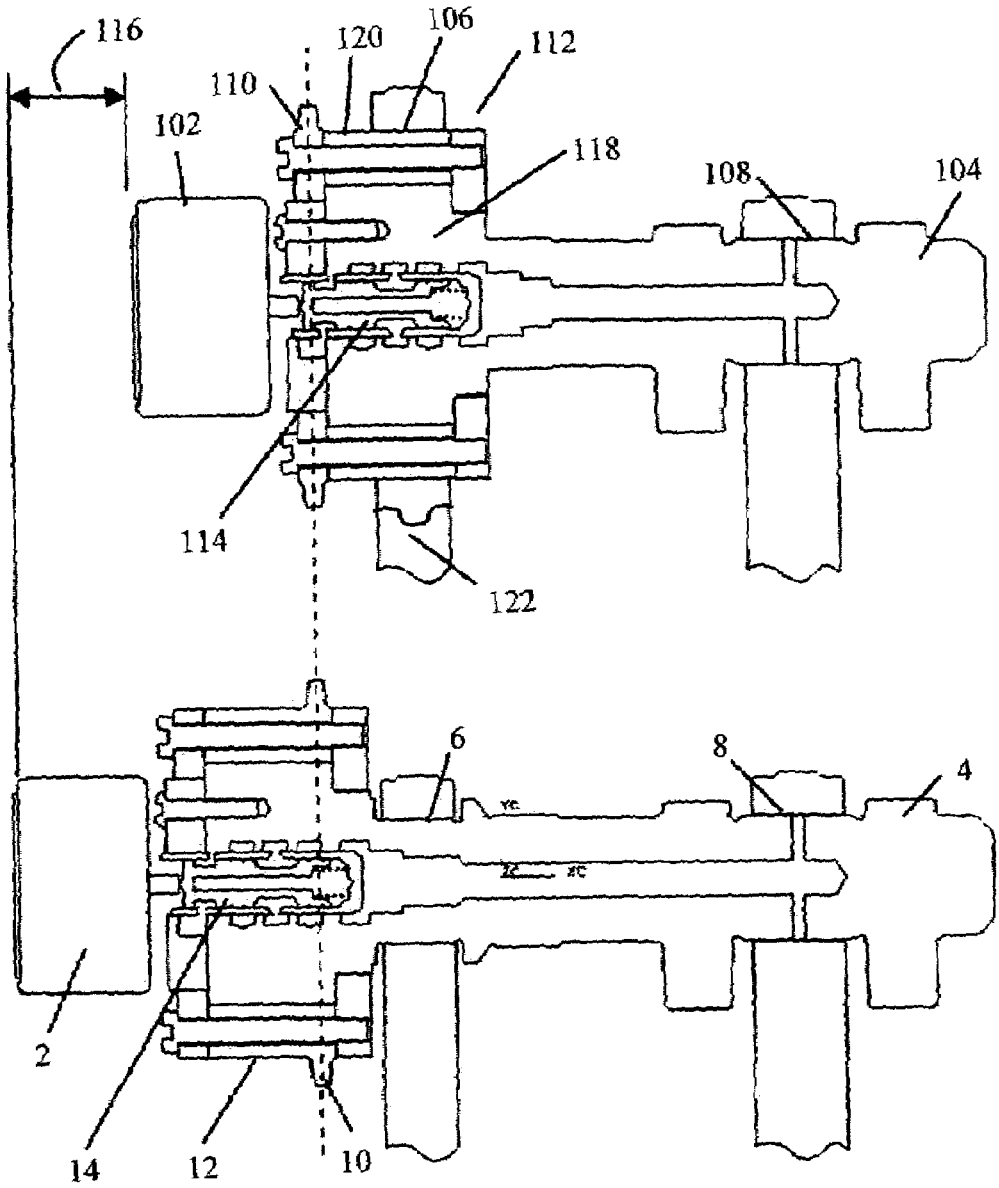
FIG. 3 shows a schematic comparing the axial length of the present invention to the prior art.

FIG. 3 shows a schematic with the difference in axial length 116 of the present invention, in which the VCT mechanism 112 and the journal bearing 106 acts as the camshaft journal bearing, to the prior art, in which the VCT mechanism 12 is located in front of the first camshaft journal bearing 6. The VCT mechanism 112 of the present invention is recessed axially further into the cylinder head, providing a significant reduction the overall length of the system.

The camshaft 104 is shown with the first journal bearing 106 supporting the outer circumference of the housing 120 of the VCT mechanism 112 and a second journal bearing 108, though additional bearings may be present and any of the bearings may support the outer circumference of the housing 120. The amount of axial length the engine may be decreased is dependent on the application, and will vary based on the specific design parameters of the engine head and the VCT system.

The VCT mechanism or phaser 112 may be an oil pressure actuated (OPA) phaser, a cam torque actuated (CTA) phaser, or a torsion assist (TA) phaser. The control valve 114 may be located remote from the phaser. The control valve actuator 102 may be a variable force solenoid (VFS), a hydraulic solenoid, or a differential pressure control system (DPCS).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine having at least one camshaft comprising:

a housing having an outer circumference for accepting drive force;

a rotor for connection to the camshaft coaxially located within the housing, the housing and the rotor defining at least one vane separating a chamber in the housing, the vane being capable of rotation to shift the relative angular position of the housing and the rotor;

wherein a portion of the outer circumference of the housing is supported by a journal bearing fixed to a non-rotating part of the engine.

2. The variable cam timing phaser of claim 1, wherein the non-rotating part of the engine is the engine block.

3. The variable cam timing phaser of claim 1, wherein the non-rotating part of the engine is the cylinder head.

* * * * *